United States Patent [19]

Takahashi

[11] Patent Number: 4,752,811

[45] Date of Patent: Jun. 21, 1988

[54] CONTROL DEVICE FOR PAPER SEPARATING CLAW OF A COPIER

[75] Inventor: Kozo Takahashi, Nara, Japan

[73] Assignee: Sharp Kabushiki Kaisha, Osaka, Japan

[21] Appl. No.: 21,965

[22] Filed: Mar. 5, 1987

[30] Foreign Application Priority Data

Mar. 28, 1986 [JP] Japan ..... 61-46723[U]

[51] Int. Cl.[4] ..... G03G 15/00

[52] U.S. Cl. ..... 355/3 SH; 355/14 SH; 355/14 R

[58] Field of Search ..... 355/3 R, 3 SH, 14 SH

[56] References Cited

U.S. PATENT DOCUMENTS 4,511,238 4/1985 Hori ..... 355/3 SH
4,525,058 6/1985 Hirabayashi et al. ..... 355/3 SH X
4,552,448 11/1985 Davidson ..... 355/3 SH
4,561,760 12/1985 Kawano et al. ..... 355/3 R

*Primary Examiner*—A. C. Prescott
*Attorney, Agent, or Firm*—Flehr, Hohbach, Test, Albritton & Herbert

[57] ABSTRACT

A copier includes a claw for removing copy paper from the surface of its photoreceptor. The claw is movable back and forth perpendicularly to the surface of the photoreceptor. It is moved nearer to the photoreceptor surface by a control unit when it is determined by a judging device that copy paper is fed from a particular tray which is likely to be used for the kind of copy paper needing the claw to be separated from the photoreceptor. If it is judged instead that copy paper is fed from a cassette, it is presumed that easily removable copy paper of an ordinary type is used and the control unit keeps the claw separated from the photoreceptor surface.

4 Claims, 4 Drawing Sheets

1
2
3
4
5
6
7
8
9
10
11
12
13
14
15
16
17
18
19
20
21
21'
22
23
24
25
26
27
28
28
29
51

CONTROL DEVICE FOR PAPER SEPARATING CLAW OF A COPIER

BACKGROUND OF THE INVENTION

This invention relates to a control device for a paper separating claw used in a copier.

There are many copiers which are provided not only with a paper separation charger for effecting an AC corona discharge to erase charge on the copy paper and to thereby separate the paper from the external surface of the photoreceptor but also with a member shaped like a claw which is constantly in contact with the surface of the photoreceptor so that the copy paper is sure to be removed therefrom. When copy paper of standard thickness is used under normal conditions of copying operation such as when paper is fed from the copier's paper feeding cassette, however, the copy paper can be separated from the photoreceptor surface perfectly well with the paper separation charger alone without the use of a claw.

When a special type of copy paper which may be very thin or very thick is supplied from a manual paper feed tray or the like, or when images are transferred onto both sides of a copy sheet in a two-side copying operation, however, the copy paper sometimes cannot be separated completely from the external surface of the photoreceptor by the discharge of the paper separation charger alone. In such a situation, the help of a claw becomes necessary.

With a conventional copier, the claw is always in touch with the photoreceptor surface. Thus, there is a high probability of damage to the photoreceptor surface caused by its contact with the claw and such damage can adversely affect the quality of the produced copies.

SUMMARY OF THE INVENTION

It is therefore an object of the invention to substantially reduce the damage to the photoreceptor surface caused by its contact with a paper separating claw by allowing the claw to remain in touch with the photoreceptor surface only when copy paper is fed from a certain tray rather than from a cassette because copy paper of a type which is hard to separate is likely to be supplied manually and by keeping the claw away from the photoreceptor surface when standard copy paper is supplied from a cassette.

The above and other objects of the present invention are achieved by providing a control unit comprised of a mechanism for moving a claw back and forth in a radial direction of the photoreceptor, a judging device for determining whether copy paper is fed manually, for example, from a manual paper feed tray or the like, and a control unit for causing the claw to be moved according to an input from the judging device. For example, if the operator of the copier presses a mode switching button on the control panel, the control device can conclude therefrom that the copier is going to be operated in the manual paper feed mode and drives the claw-moving mechanism to bring the claw nearer to or into contact with the photoreceptor surface.

BRIEF DESCRIPTION OF THE DRAWINGS

The accompanying drawings, which are incorporated in and form a part of this specification, illustrate an embodiment of the present invention, and together with the description, serve to explain the principles of the invention. In the drawings.

DETAILED DESCRIPTION OF THE INVENTION

Figure 1:
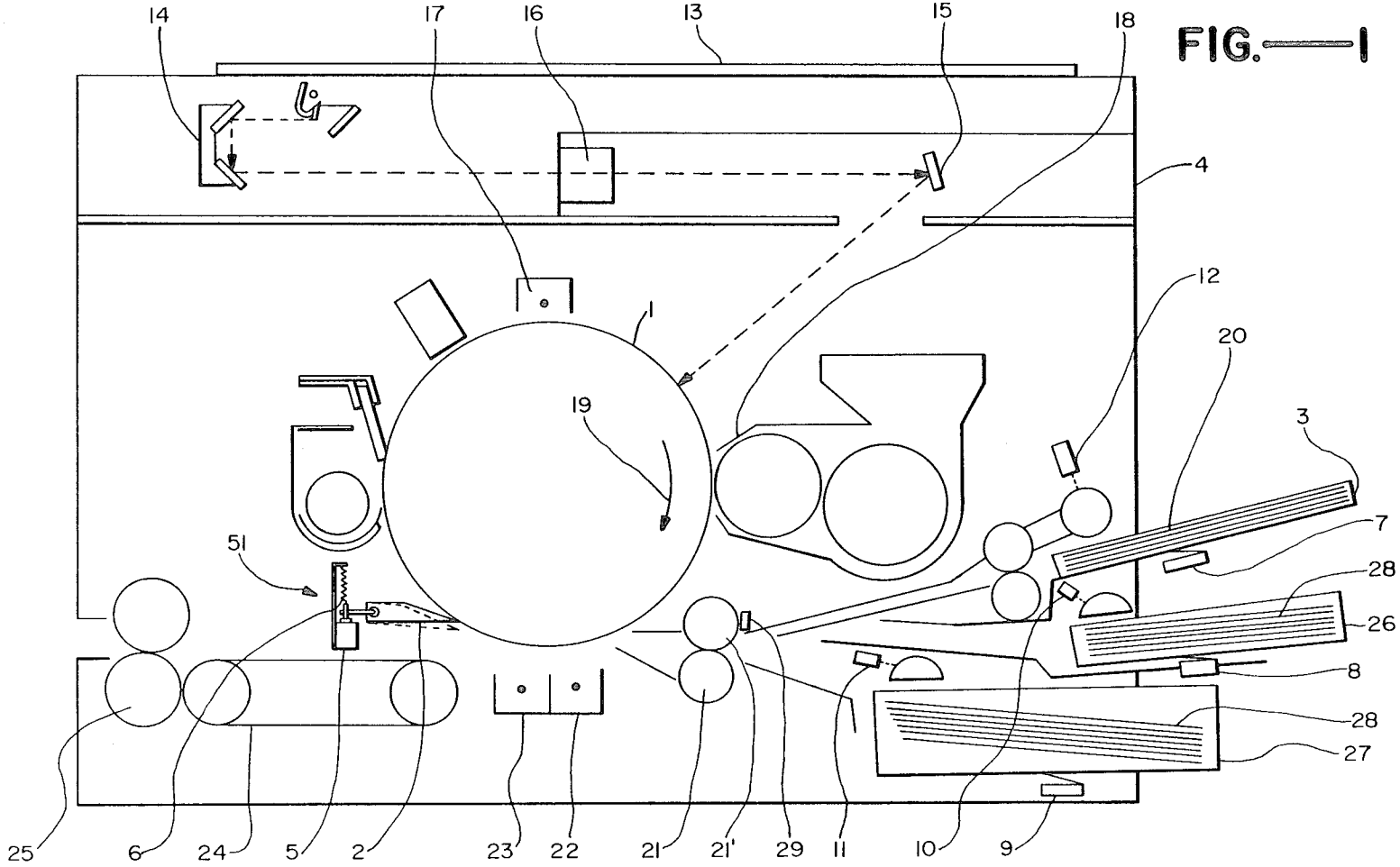
FIG. 1 is a schematic side sectional view showing the structure of a copier incorporating a control device for paper separating claw embodying the present invention.
Figure 2:
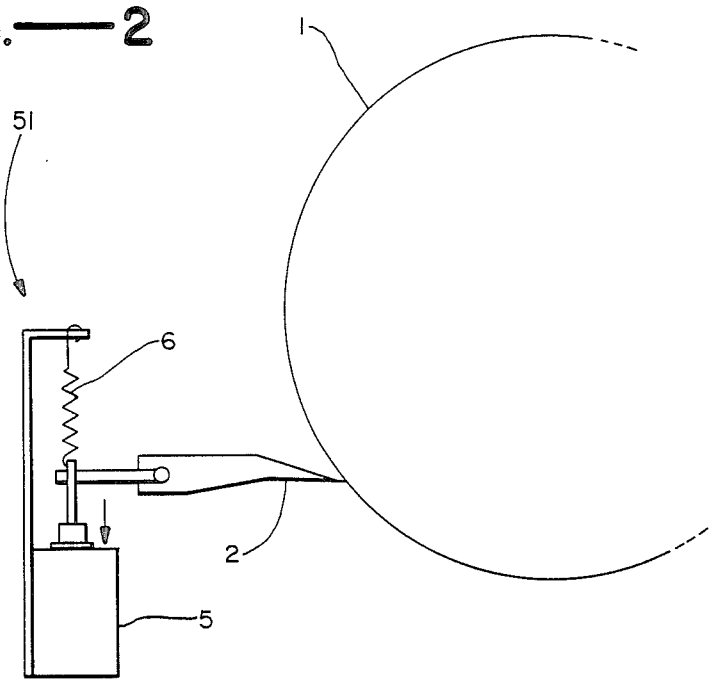
FIG. 2 is a schematic side view of the paper separating claw of FIG. 1 when it is in contact with the photoreceptor surface.
Figure 3:
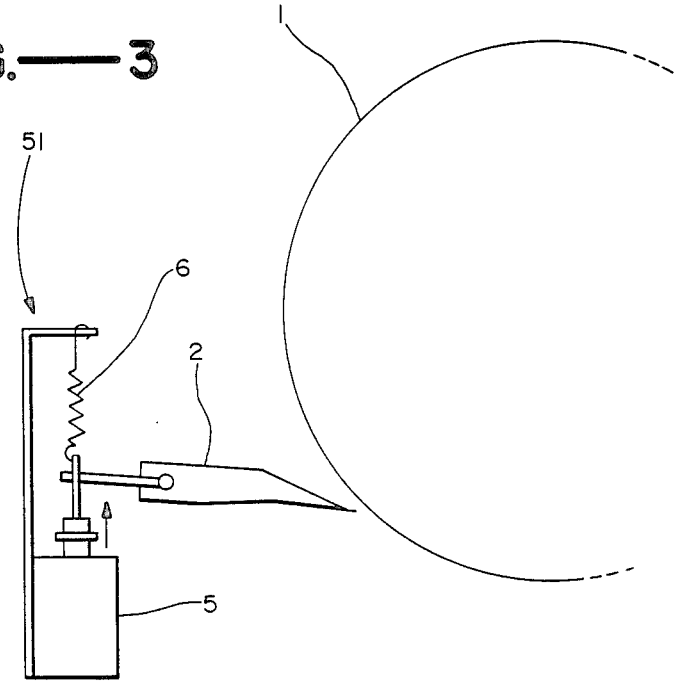
FIG. 3 is a schematic side view of the paper separating claw of the FIG. 1 when it is removed from the photoreceptor surface.

With reference to FIG. 1 which schematically shows the structure of a copier incorporating a control device of the present invention, numerial 1 indicates a photoreceptor and numeral 2 indicates a claw which can be moved back and forth in the direction of a radius of the photoreceptor 1 as shown in FIGS. 2 and 3 so as to separate a sheet of copy paper from the surface of this photoreceptor 1. A judging device to be described in detail below for judging that copy paper is going to be fed next from a manual paper feed tray 3 rather than from either of cassettes 26 and 27 is also provided and a control unit 52 to be described below by way of FIG. 4 controls the driving mechanism 51 for the motion of the claw 2 according to signals received from the judging device.

As shown in FIGS. 1–3, the claw 2 is rotatably supported around an axis affixed to the interior of the housing 4 and the driving mechanism 51 for moving the claw 2 back and forth includes , as shown in FIG. 2 and 3, a solenoid 5 for causing the claw 2 to come into contact with the surface of the photoreceptor 1 and a spring 6 for pulling the claw 2 away from the surface of the photoreceptor 1.

Figure 4:
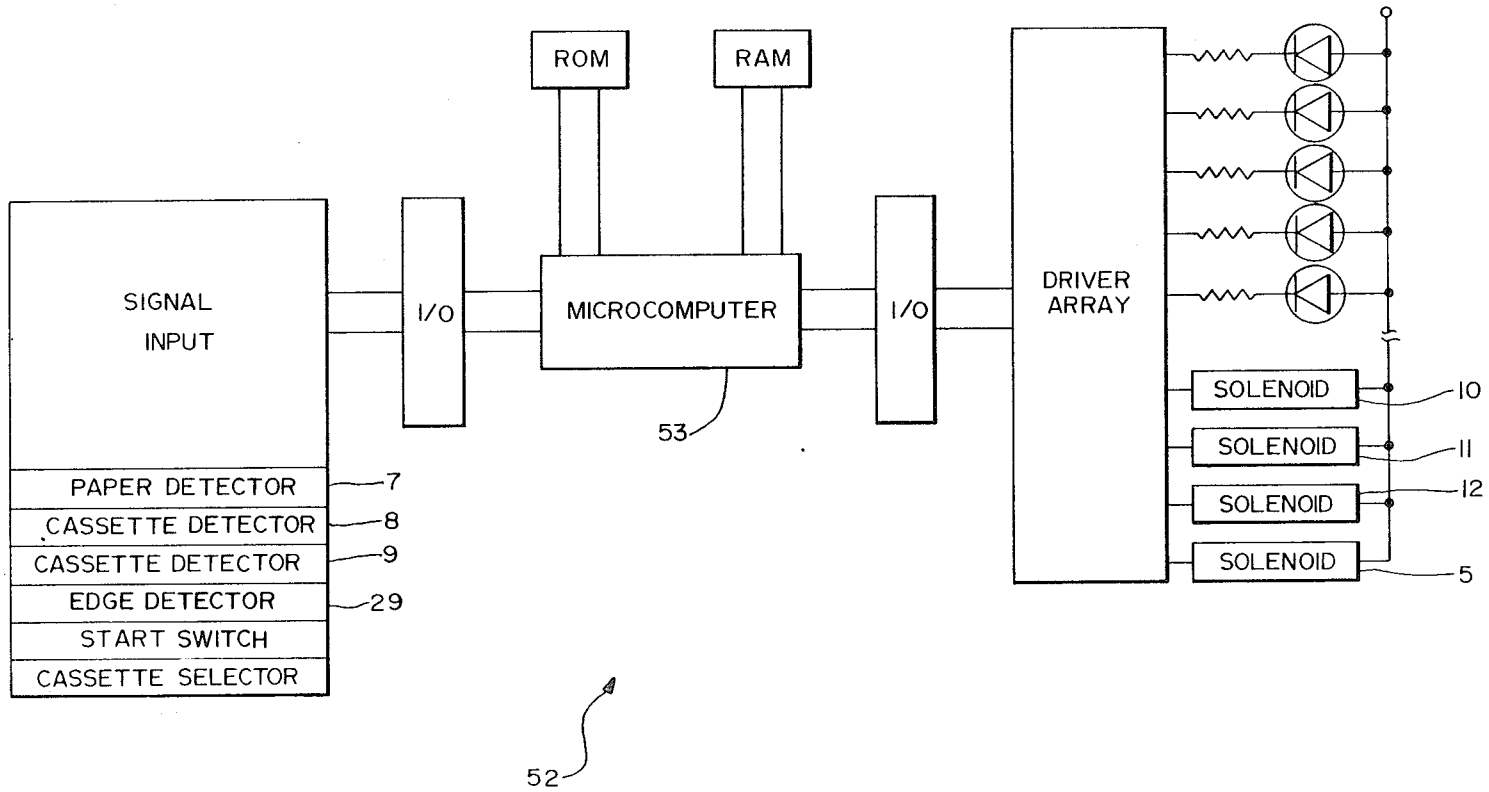
FIG. 4 is a block diagram of the control circuit for the paper separating claw embodying the present invention.

As shown further in FIG. 1, the copier also includes a paper detection switch 7 for detecting whether copy paper is set on the manual paper feed tray 3 attached to the copier housing 4. The housing 4 also carries thereon paper cassette detection switches 8 and 9 for detecting whether the paper cassettes 26 and 27 are mounted or not and a photoelectric detector 29 for detecting the forward edge of the copy paper transported to feed rollers 21 and 21'. The aforementioned juding device for judging whether or not the copy paper will be fed from the manual paper feed tray 3 and the control unit 52 for controlling the motion of the claw 2 according to an input signal of the judging device are both operated by a program prepared for a microcomputer 53 as shown in FIG. 4. The microcomputer 53 serves to selectively activate cassette paper feed solenoids 10 and 11 attached to the housing 4, a manual paper feed solenolid 12 and the aforementioned claw operating solenoid 5 for moving the claw 2 in response to input signals received from the aforementioned detection switches 7, 8, 9 and 29 as well as selection switches on a control panel (not shown) of the housing 4.

Figure 5:
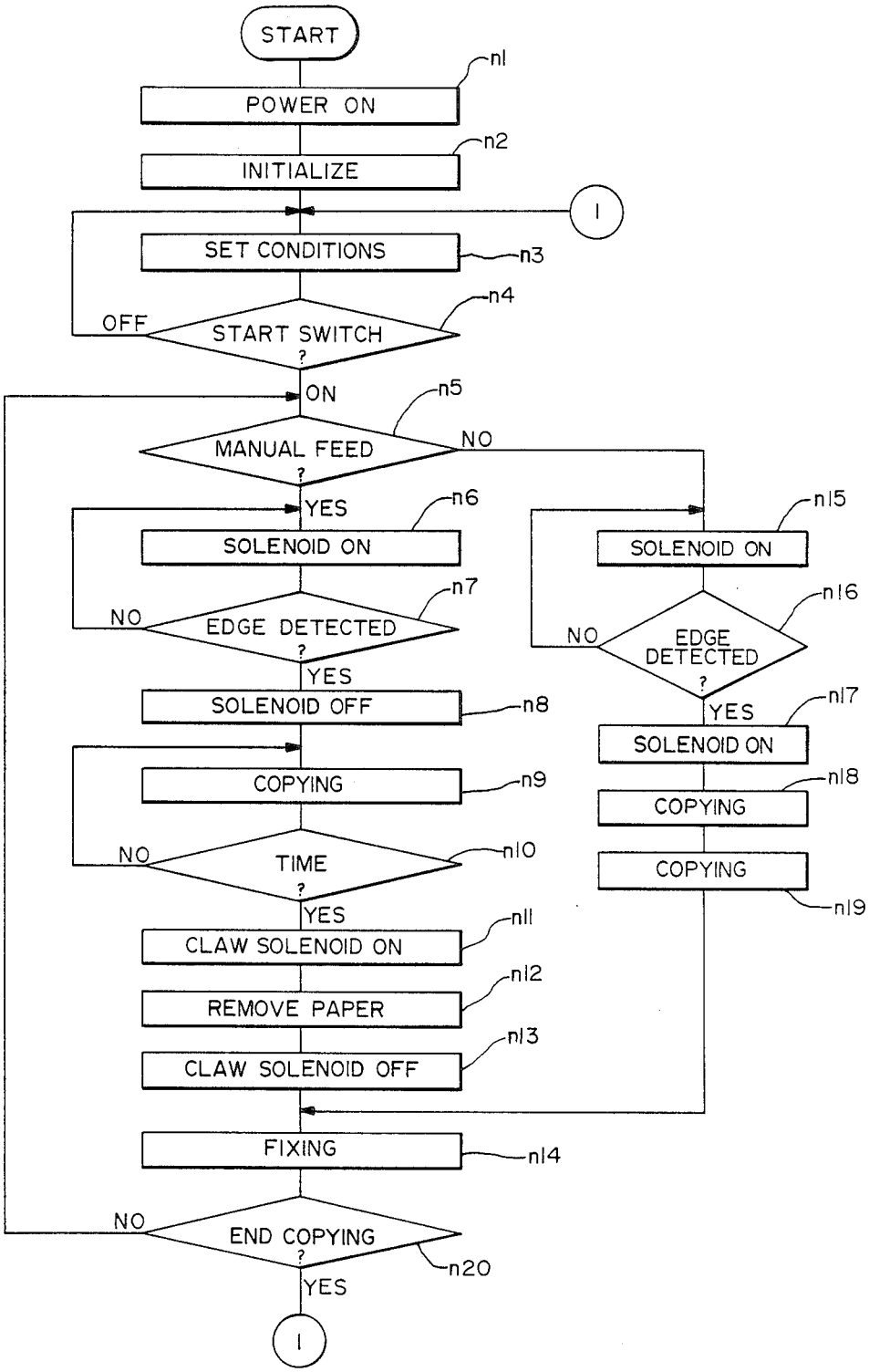
FIG. 5 is a flow chart for the operation of the control device of the present invention.

Operation of the control device embodying the present invention described above is explained next by way of FIGS. 1, 4 and 5. When the operator switches on power (n1), the microcomputer 53 executes an initialization program (n2) as a result of which various prerequisite initial conditions for a copying process are set such as the specification of a cassette from which copy paper is to be fed. An original to be copied (not shown) is placed on a glass plate 13 at the top of the housing 4 and the initialization is completed.

Next, the mode of operation wherein copying is effected on copy paper 20 from the manual paper feed tray 3 (YES in n5) is explained. First, the operator sets the number of copies to be made, copy density and other conditions and selects the manual paper feed mode by operating the paper tray selection switch (FIG. 4). The microcomputer 53 thereupon checks the paper detection switch 7 to determine whether paper is set in the manual paper feed tray 3. If no output signal from the paper detection switch 7 is received by the microcomputer 53, the microcomputer 53 causes a display to be made to the effect that paper 20 is not set in the manual paper feed tray 3. The control program is so prepared that the start switch cannot be turned on although it is pressed if there is no copy paper available. The microcomputer 53 also serves to specify control programs for the solenoids 12 and 5 which are already stored in a memory device.

When the start switch for copying is operated (n4) after the conditions of operation are set (n3), reflected light from the original placed on the glass plate 13 is made incident by means of an optical system including mirrors 14 and 15 and a lens 16 onto the surface of the photoreceptor 1 which is electrostatically charged by a main charger 17, forming a latent image thereon. This latent image is developed into a toner image at a developing device 18 and becomes invisible. The visible toner image moves in the direction of the arrow 19 as the photoreceptor 1 rotates.

In the meantime, copy paper 20 is transported from the manual paper feed tray 3 to the feed rollers 21 and 21' by the operation of the manual paper feed solenoid 12 (n6). As soon as it is detected by the photoelectric detector 29 that the front edge of the paper 20 has been inserted between the feed rollers 21 and 21' (YES in N7), the manual paper feed solenoid 12 is turned off (n8) and the feed rollers 21 and 21' begin to rotate, sending the paper 20 to come into contact with the photoreceptor 1. Next, a transfer charger 22 is discharged to transfer the visible toner image onto the copy paper 20 and static electricity is thereafter removed from the paper 20 by a discharge of a separation charger 23 (n9).

The front edge of the copy paper 20 reaches the position of the claw 2 after a fixed time period has passed since the feed rollers 21 and 21' begin to turn. At this moment (YES in n10), the solenoid 5 for moving the claw 2 is activated (n11) and causes the claw to come into contact with the surface of the photoreceptor 1. As a result, the paper 20 is peeled off from the surface of the photoreceptor 1 (n12). Thereafter, the solenoid 5 is deactivated with its power switched off and the claw 2 is pulled away from the surface of the photoreceptor 1 by the force of the spring 6 (n13). In the meantime, the paper 20 with a visible toner image having transferred there onto is sent to a fixing device 25 by means of a conveyor belt 24 and the image is fixed (n14).

When copying is effected on an ordinary type of copy paper 28 (NO in n5), the operator specifies one of the cassettes 26 and 27 and the microcomputer 53 checks the input signal from the corresponding paper cassette detection switch 8 or 9 to determine whether the selected cassette 26 or 27 is set to the housing 4. If no output signal from the paper cassette detection switch 8 or 9 is received by the microcomputer 53, the microcomputer 53 causes a display to this effect to be made on the control panel. The control program is also programmed such that the start switch cannot be turned on although it is pressed if there is no cassette set to the housing 1. The microcomputer 53 also serves to specify control programs to the cassette paper feed solenoids 10 and 11 which are already stored in the memory device. In this mode of operation wherein copy paper of an ordinary type is fed from one of the cassettes 26 and 27, the control program for the claw-operating solenoid 5 is not specified because the claw 2 is not required to come into contact with the surface of the photoreceptor 1.

When the start switch for copying is operated, a visible toner image formed on the photoreceptor 1 moves in the direction of the arrow 19 as explained above. In the meantime, copy paper 28 is transported from the cassette 26 or 27 to the feed rollers 21 and 21' by the operation of the cassette paper feed solenoid 10 or 11 (n15). As soon as it is detected by the photoelectric detector 29 that the front edge of the paper 28 has been inserted between the feed rollers 21 and 21' (YES in n16), the solenoid 10 or 11 is turned off (n17), and the feed rollers 21 and 21' begin to rotate, sending the paper 28 to come into contact with the surface of the photoreceptor 1. Next, the transfer charger 22 is discharged to transfer the visible toner image from the surface of the photoreceptor 1 onto the copy paper 28 and static electricity is removed therefrom by a discharge of the separation charger 23 (n18). This causes the paper 28 to separate from the surface of the photoreceptor 1 (n19). Thereafter, the separated paper 28 is carried by the conveyor belt 24 to the fixing device 25 where the transferred imaged is fixed (n14). In summary, the device of the present invention does not use the claw 2 when copying is effected onto copy paper of ordinary type. As a result, damage to the surface of the photoreceptor by the claw can be significantly reduced.

The foregoing description of a preferred embodiment of the invention has been presented for purposes of illustration and description. It is not intended to be exhaustive or limit the invention to the precise form disclosed. Any modifications and variations apparent to a person skilled in the art are intended to be included in the scope of this invention.

What is claimed is:

1. A combination in a copier comprising a claw for separating copy paper from a photoreceptor surface, said claw being movable back and forth perpendicularly to said surface, judging means for judging whether copy paper is supplied from a manual paper feed tray or not, and control means for moving said claw according to an output signal from said judging means.

2. The combination of claim 1 wherein said claw is rotatably supported around an axis and is attached to a spring for applying a biasing force thereon and a claw-operating solenoid which serves to move said claw against said biasing force.

3. The combination of claim 1 wherein said judging means include a selection switch for selecting said tray and causing copy paper to be fed from said tray.

4. The combination of claim 1 wherein said control means include a microcomputer which is programmed to operate said claw differently, depending on whether copy paper is fed from said tray or not according to said judging means.

* * * * *

UNITED STATES PATENT AND TRADEMARK OFFICE

CERTIFICATE OF CORRECTION

PATENT NO. : 4,752,811

DATED : June 21, 1988

INVENTOR(S) : Kozo Takahashi

It is certified that error appears in the above-identified patent and that said Letters Patent is hereby corrected as shown below:

Column 3, about line 33, change "invisible" to --visible--.

Signed and Sealed this

Twenty-ninth Day of November, 1988

*Attest:*

DONALD J. QUIGG

*Attesting Officer*

*Commissioner of Patents and Trademarks*